US005383325A

United States Patent [19]

Schott

[11] Patent Number: 5,383,325

[45] Date of Patent: Jan. 24, 1995

[54] DEVICE FOR FEEDING SPHERICAL BODIES INTO A CONTAINER

[75] Inventor: Helmut Schott, Satteldorf, Germany

[73] Assignee: Robert Bosch GmbH, Stuttgart, Germany

[21] Appl. No.: 50,784

[22] Filed: Apr. 21, 1993

[30] Foreign Application Priority Data

Jun. 12, 1992 [DE] Germany ..... 4219223

[51] Int. Cl.[6] ..... B65B 5/10; B65B 35/06; B65B 35/26; B65B 57/20

[52] U.S. Cl. ..... 53/500; 53/501; 53/244; 53/248; 221/277; 198/550.1

[58] Field of Search ..... 53/500, 501, 244, 248, 53/284.5; 221/265, 277; 198/550.1

[56] References Cited

U.S. PATENT DOCUMENTS

| | | | |
|---|---|---|---|
| 1,641,476 | 9/1927 | Edwards | 53/244 X |
| 2,509,069 | 5/1950 | Mrachek | 53/244 |
| 2,585,558 | 2/1952 | Lakso | 534/244 |
| 2,883,816 | 4/1959 | Kroll | 53/244 |
| 4,902,263 | 2/1990 | Ito et al. | 221/277 X |
| 4,911,282 | 3/1990 | Melnikov et al. | 198/550.1 |
| 4,992,075 | 2/1991 | Miyamoto | 53/500 X |
| 5,064,092 | 11/1991 | Grossi | 221/277 X |
| 5,082,141 | 1/1992 | Martin et al. | 221/277 X |
| 5,097,985 | 3/1992 | Jones | 221/277 X |
| 5,176,288 | 1/1993 | Craven | 221/277 X |

*Primary Examiner*—Horace M. Culver

*Attorney, Agent, or Firm*—Edwin E. Greigg; Ronald E. Greigg

[57] ABSTRACT

A device for feeding a specific number of spheres into a container from a supply conduit via a sphere-metering device so that a predetermined number of spheres reaches a container. The metering device has a groove that is aligned with the outlet of the supply conduit and the opening of the positioned container and functions in conjunction with a cylindrical worm conveyor that covers this opening laterally and whose axis of rotation runs parallel to the extension of the groove. As the worm conveyor rotates by one turn, the spirals in cooperation with the stationary groove, guide the required number of spheres form-fittingly and forcibly into the container. A sensor of a monitoring device detects the conveyance of the spheres in order to feed the proper number of spheres to the container.

10 Claims, 1 Drawing Sheet

DEVICE FOR FEEDING SPHERICAL BODIES INTO A CONTAINER

BACKGROUND OF THE INVENTION

The invention is based on a device for cyclic feeding of a specific number of spherical bodies into a container. With a known device of this type, in one position of a slide, one or a plurality of spheres slide from a supply conduit into a measuring chamber in the slide and, in another position of the slide, the plurality of spheres fall through the guide conduit into the container aligned for this purpose. A sensor of a monitoring device assigned to the supply conduit records the passage of one or a plurality of spheres in each cycle. With this device it occurs repeatedly that spheres that have been registered by the monitoring device do not enter the container, either because they remain in the guide conduit during a stroke and fall out later or fall into the next container during the next cycle, or because irregularities in the spheres cause the guide conduit to become plugged.

The presence of a sphere or a specific number of glass or steel spheres in a pharmaceutical syringe is, however, essential for the distribution of settled active ingredients by shaking before use. It is thus desirable to have a feeding device on a filling machine with which it is assured that the necessary number of spheres is deposited into a container in each operating cycle.

OBJECT AND SUMMARY OF THE INVENTION

The feeding device in accordance with the invention has an advantage that, by means of forced guiding from the supply conduit to the opening of the container, the sphere or spheres registered by the monitoring device assuredly reach the container, so that when the syringe is shaken, the active ingredients that have settled there are distributed evenly throughout the liquid so that the injected material contains the prescribed quantity of active ingredients. Moreover, the device has a simple and clear design. Its cyclic rotary operation can be easily executed.

Advantageous refinements of the feeding device disclosed in claim 1 are made possible by means of the measures explained hereinafter.

The invention will be better understood and further objects and advantages thereof will become more apparent from the ensuing detailed description of the preferred embodiment taken in conjunction with the drawings.

DESCRIPTION OF THE PREFERRED EMBODIMENT

Figure 1:
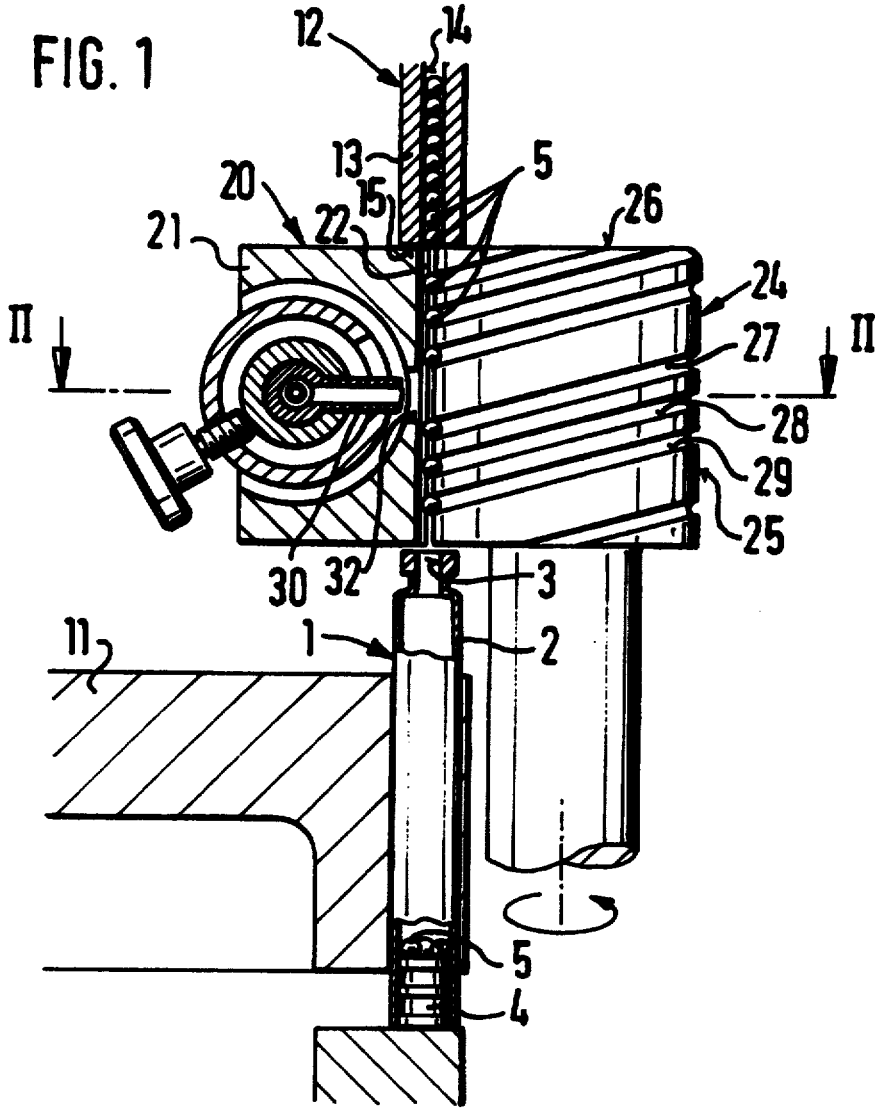
FIG. 1 shows a side view, partly in section of a device for feeding spheres into a container.
Figure 2:
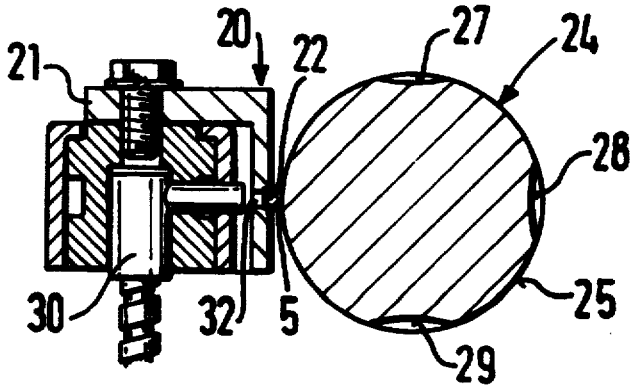
FIG. 2 shows the feeding device in accordance with FIG. 1 in cross-section, in the plane II—II of FIG. 1.

Containers to be filled with a pharmaceutical injection liquid, such as syringes 1, which have a cylindrical body 2 with an upper opening 3 and an end sealed by a stopper 4, are guided upright in steps by means of a packaging machine with a compartmented wheel 11 to the individual processing stations. A device for feeding one or a plurality of spheres 5 into the syringe 1 is assigned to such a processing station disposed in front of the filling station.

The feeding device for spheres has a supply conduit 12, into which the spheres 5 to be metered are steadily fed. The supply conduit 12 comprises a tube 13, preferably of a transparent material, with a longitudinal bore 14, whose opening is slightly larger than the diameter of the sphere 5, so that the spheres 5 are stacked there individually in a row on top of one another. A sphere-metering device 20 is disposed between the lower end 15 of the tube 13 and the level of the fill opening of a positioned syringe 1. This device has a stationary block 21 with a vertical groove 22, which forms a guide track whose upper end is aligned with the outlet end 15 of the tube 13, and whose lower end is aligned with the opening 3 of a positioned syringe 1. The groove 22 has a cross-section that only receives a part of a guided sphere 5. The cross-section of the groove 22 can be adapted to the radius of the spheres 5, but can also have a rectangular or triangular shape, so that the spheres 5 are guided along the sides of its edges. The groove 22 of the block 21 is assigned a cylindrical worm conveyor 24 whose height is the same as the length of the groove 22, and which is rotatably seated around an axis parallel to the longitudinal extension of the groove 22, so that the opening of the groove 22 is covered for a defined distance by the casing of the cylinder 25 of the worm conveyor 24. In this arrangement the rim area of the upper face end 26 of the cylinder 25 also covers the lower opening of the longitudinal bore 14 of the tube 13 from time to time, because of which the bottom sphere is held back in the tube 13. Depending on the number of spheres 5 to be metered into a syringe 1, the worm conveyor 24 has a corresponding number of spirals 27, 28, 29 in the circumference of the cylinder 25, for example three, as in the illustrated exemplary embodiment. The spirals 27, 28, 29 are shaped as grooves whose cross-section likewise receives only a part of a sphere 5. In the exemplary embodiment the spirals have a rounded cross-section. The lead of the spirals 27, 28, 29 is selected such that they preferably circle the circumference of the cylinder twice. The worm conveyor 24 is driven by a constant-speed clutch (not shown) that is known per se and is connected to the drive of the packaging machine.

The described feed device for spheres operates in the following manner:

Once the compartmented wheel 11 has positioned the syringe 1 under the sphere-metering device 20 (FIG. 1), the constant-speed clutch is activated so that the worm conveyor 24 executes a complete rotation via the clutch. As the upper ends of the spirals 27, 28, 29 pass beneath the outlet end 15 of the longitudinal bore 14 of the supply conduit 12, a sphere 5 slides out of the longitudinal bore 14 into the guide conduit, which is formed by the groove 22 in the block 21 and the spirals 27, 28, 29. The spheres 5 are form-fittingly guided in this guide conduit, in a vertical direction, from the groove 22 in the block 21 and horizontally by means of the spirals 27, 28, 29, and the spheres 5 are necessarily guided downward as the worm conveyor 24 rotates. Because the spirals 27, 28, 29 of the worm conveyor 24 circle twice, three spheres 5 are taken up from the supply conduit 12 during each rotation of the worm conveyor 24, and three others that were taken up during the preceding cycle are released from the guide conduit at the lower end of the groove 22 so that they can be placed directly into a syringe 1, through its aligned opening 3.

To check whether the required number of spheres 5 is metered with each rotation of the worm conveyor 24, a sensor 30 of a monitoring device is assigned to the guide conduit. The sensor 30, which preferably operates optical-electrically, is disposed in the block 21 and is oriented toward the groove 22 through a cut-out 32. As a sphere 5 is guided past, the sensor 30 emits a signal to the monitoring device. If one or a plurality of the predetermined number of signals should fail to be received during an operating cycle, the positioned syringe 1 is removed from the compartmented wheel 11 at a suitable place. If several signals should fail to be received during a certain filling period, the machine is turned off.

It is additionally noted that the described feeding device is designed for metering and depositing three spheres, for which purpose the worm conveyor 24 has three spirals 27, 28, 29. If a different number of spheres is to be metered, a worm conveyor is used that has a number of spirals corresponding to the required number of spheres. Alternatively, for metering a lesser number of spheres than the number of spirals, the inlet of one or more spirals can be closed.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A device for cyclic feeding of a specific number of spherical bodies into a container (1), said device having a supply conduit (13), in which a plurality of spheres (5) are stored in a row aligned next to each other, a metering member disposed between a lower end of said supply conduit and said container that cyclically takes up a specific number of spheres one at a time from the supply conduit and guides said spheres into a guide conduit leading to a container, a monitoring system for detecting the guided spheres, the supply conduit and the metering member are formed by a straight guide track (22) juxtaposed worm spirals (27, 28, 29) of a worm conveyor (24) of a cylinder (25) having an axis parallel to an axis of the guide track and which rotates about said parallel axis, the spheres (5) are conveyed to the worm spirals (27, 28, 29) on an upper end (26) of the worm conveyor (24) so that the end (26) of the worm conveyor (24) intermittently covers the underside of the longitudinal bore (14) of the supply conduit (13), so that the spheres (5) received from the supply conduit (12) during rotation of the worm conveyor (24) are form-fittingly guided between the guide track (22) and the spirals (27, 28, 29) to an opening (3) of the container (1).

2. The device as defined by claim 1, in which an outlet end (15) of the supply conduit (12) is partially aligned with said guide track (22) and partially alternatingly with a face end or the entrance of a spiral (27, 28, 29) of the worm conveyor.

3. The device as defined by claim 2, in which the guide track is embodied as a vertical groove (22) in a guide block (21).

4. The device as defined by claim 3, in which a sensor (30) of a monitoring device is disposed in the guide block (21).

5. The device as defined by claim 2, in which a sensor (30) of a monitoring device is disposed in the guide block (21).

6. The device as defined by claim 1, in which the guide track is embodied as a vertical groove (22) in a guide block (21).

7. The device as defined by claim 6, in which a sensor (30) of a monitoring device is disposed in the guide block (21).

8. The device as defined by claim 1, in which a sensor (30) of a monitoring device is disposed in the guide block (21).

9. The device as defined in claim 1, in which the worm conveyor (24) has a number of worm spirals (27, 28, 29) on a circumference of said cylinder (25) that corresponds to the number of spheres (5) to be metered per container (1).

10. A device as set forth in claim 9, in which each of said spirals has a rotation of 360 degrees over a length of said cylinder.

* * * * *